United States Patent [19]

Wieland

[11] 4,450,972

[45] May 29, 1984

[54] CHILD-RESISTANT CONTAINER

[76] Inventor: Clarence W. Wieland, 1531 Hyde St. #8, San Francisco, Calif. 94109

[21] Appl. No.: 499,120

[22] Filed: May 31, 1983

[51] Int. Cl.[3] ..... B65D 55/02

[52] U.S. Cl. ..... 215/221

[58] Field of Search ..... 215/217, 218, 221, 330

[56] References Cited

U.S. PATENT DOCUMENTS

| | | | |
|---|---|---|---|
| 2,980,275 | 4/1961 | Lundgren | 215/330 |
| 3,514,003 | 5/1970 | Fitzgerald | 215/221 |
| 4,106,651 | 8/1978 | Lemons | 215/221 |

*Primary Examiner*—George T. Hall

*Attorney, Agent, or Firm*—Townsend and Townsend

[57] ABSTRACT

A child-resistant container includes a receptacle having an open top and a threaded cap covering the open top. The threads are preferably left-hand threads to help prevent the opening of the container by small children. The outer surfaces of the receptacle and cap define a common groove along their abutting edges. A removable elastic band is mounted within the groove with its inner surface fitting snuggly against the groove surfaces so that relative rotary motion between the cap and receptacle is resisted by the band. When young children try to remove the cap, turning of the cap is resisted by the band; when the cap is let go the cap tends to spring back to its original position. However, an adult can remove the cap by first removing the band from the common groove. The cap can then be removed with very little resistance.

12 Claims, 6 Drawing Figures

CHILD-RESISTANT CONTAINER

BACKGROUND OF THE INVENTION

Child-resistant containers have proven that they reduce accidental poisonings among very young children. Therefore the use of child-resistant bottles for drugs and medicine has become widespread. However, the widespread use of such containers has caused problems for many elderly or infirm persons. Often such persons are unable to open a child-resistant container and must resort to throwing the container against a wall or smashing it under foot just to get at their pills. Thus even a generally beneficial item such as a child-resistant container has it drawbacks.

One way to eliminate the problems of child-resistant container is to request that prescription medication be placed in standard containers. However, the safety of any small children who may be around can be jeopardized if this is done. Also, many non-prescription medications only come in child-resistant containers. Therefore what has been lacking in the art is a container which resists opening by small children but which allows adults, even those with limited use of their hands, to open.

SUMMARY OF THE INVENTION

The invention is directed to a child-resistant container which is openable by adults with limited use of their hands. The container includes a receptacle having an open top and a cap threadably mounted to the receptacle for covering the open top. The threads are preferably left-hand threads to help prevent the opening of the container by small children.

The outer surfaces of the receptacle and cap define a common groove along their abutting edges. An elastic band is mounted within the groove. The inner surface of the elastic band fits snuggly against the groove surfaces of the cap and receptacle. The band and groove surfaces are adapted so that relative rotary motion between the cap and receptacle are resisted by the band. When young children try to remove the cap, turning of the cap is resisted by the band. When the cap is let go, the cap tends to spring back to its original position. However, an adult can remove the cap by first removing the band from the common groove. The cap can then be removed with very little resistance. After replacement of the cap on the receptacle, the elastic band is replaced in the common groove. The elastic band may include a tab to allow an adult user to quickly remove the band from the common groove.

A primary feature of the invention is the provision of the removable elastic band which frictionally engages the outer surfaces of both the receptacle and the cap to inhibit relative rotary motion between them. Thus small children encounter both the frictional resistance between the elastic band and the cap and receptacle surfaces and also encounter the tendency of the cap to spring back once released by the child.

A second safety feature of the invention is the use of left-hand threads on the cap and receptacle so that the user must rotate the cap in a direction opposite the normal opening direction. The use of left-hand threads increases the difficulty small children have opening the containers. Written opening instructions, not understood by small children, can be applied to the container for the adult user.

Other features and advantages of the present invention will appear from the following description in which the preferred embodiments have been set forth in detail in conjunction with the accompanying drawings.

DETAILED DESCRIPTION OF THE PREFERRED EMBODIMENTS

Figure 1:
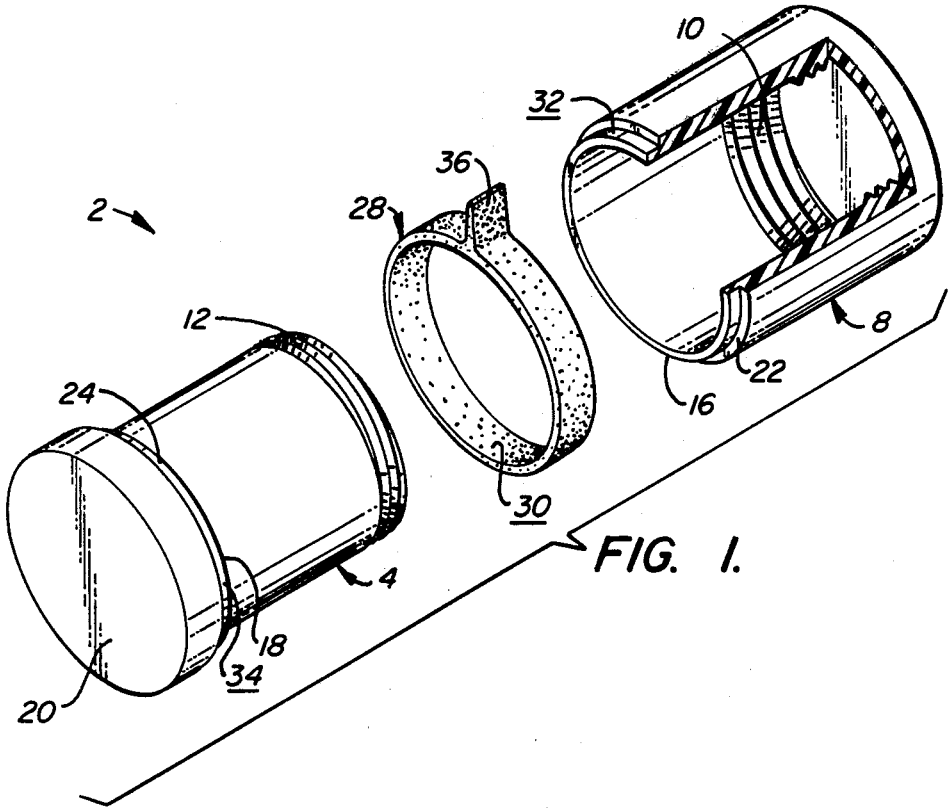
FIG. 1 is an exploded isometric view of a first embodiment of the container of the invention.
Figure 2:
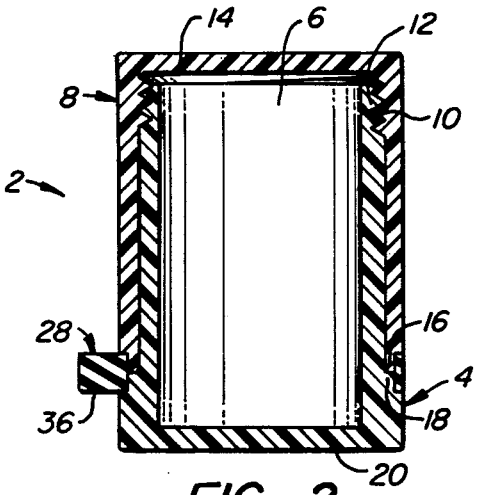
FIG. 2 is a cross-sectional view of the embodiment of FIG. 1 as assembled.

Turning now to FIGS. 1 and 2, a child-resistant container 2 is shown to include a cylindrical receptacle 4, having an open top 6 onto which a cap 8 is mounted via left-hand threads 10, 12. Cap 8 is also a generally cylindrical member having its internal left-hand threads 10 formed near the top 14 of cap 8. Threads 12 are formed adjacent open top 6 of receptacle 4. Cap 8 has an open end 16 which abuts a shoulder 18 formed near the base 20 of receptacle 4. Reduced diameter grooves 22, 24 are formed adjacent open end 16 of cap 8 and shoulder 18 of receptacle 4. Grooves 22, 24 form a common groove 26 within which an elastic band 28 seats. Elastic band 28, which fits snuggly within groove 26, provides substantial resistance to relative rotary motion between receptacle 4 and cap 8.

In use, with container 2 assembled as shown in FIG. 2, a small child has a variety of obstacles to overcome before container 2 can be opened. First, the container must be rotated in a direction opposite that which is normally used to open a container. This, it has been found, creates a substantial obstacle to opening for many small children. If a child attempts to rotate receptacle 4 and cap 8 in the proper direction, such relative rotation is substantially restricted by elastic band 28. Even if the child can rotate the cap, once the cap is released, elastic band tends to cause receptacle 4 and cap 8 to spring back to re-tighten them.

Providing groove 26 helps to position band 28 so it properly covers surfaces 32, 34. Groove 26 also helps prevent young children from removing band from surfaces 32, 34.

The amount of frictional resistance between the inside surface 30 of band 28 and grooved surfaces 32, 34 is determined by the materials used, the frictional character of surfaces 32, 34, the shapes of surfaces 32, 34, the tightness of the fit of elastic band 28 about container 2 and the extent of the frictionally engaging surfaces. In addition, the gripping surface about the circumference of receptacle 4 adjacent base 20 is purposely minimized to make it more difficult for a young child to get a good grasp on the container.

When an adult user wishes to open container 2, elastic band 28 is grasped by a tab 36 and the band is pulled at least partially away from common groove 26. After band 28 has been removed from either groove 22 or groove 24, or both, the adult user can easily remove top 8 without the rotational hindrance of elastic band 28.

Figure 3:
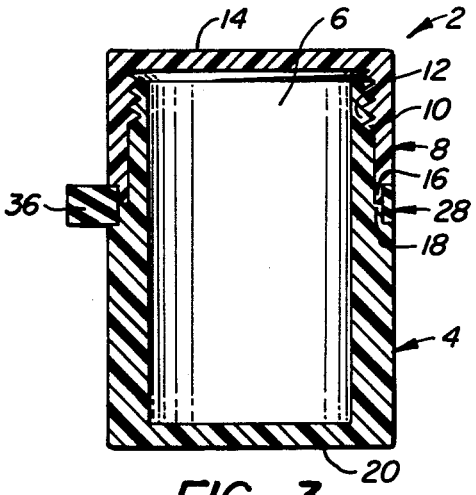
FIGS. 3 and 4 are cross-sectional views of alternative embodiments of the invention.
Figure 4:
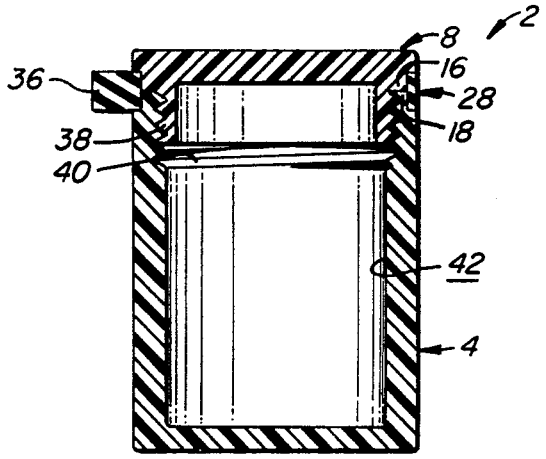

Referring now to FIGS. 3 and 4, alternative embodiments of container 2 are shown. Note that like reference numerals are used for like structural elements in the different embodiments. The embodiment of FIG. 3 differs from that of FIG. 1 in that cap 8 does not extend as far down the length of receptacle 4. The embodiment of FIG. 4 differs from that of FIG. 3 in that cap 8 has external threads 38, compared with internal threads 10, for engaging the internal threads 40 formed at the inside surface 42 of receptacle 4.

Figure 5:
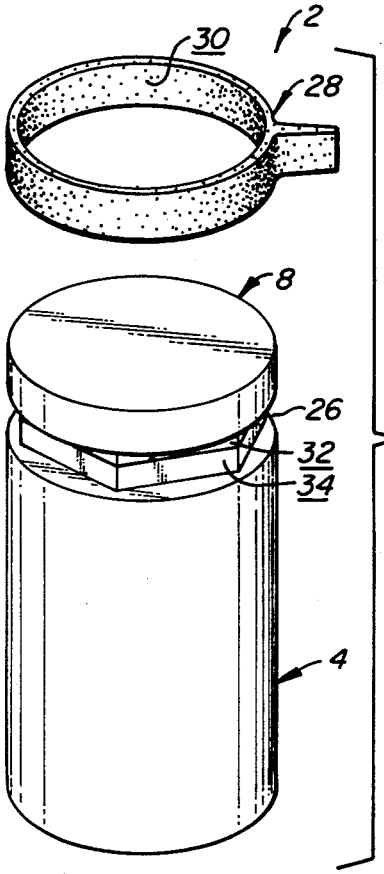
FIGS. 5 and 6 are perspective views of further alternative embodiments of the invention.
Figure 6:
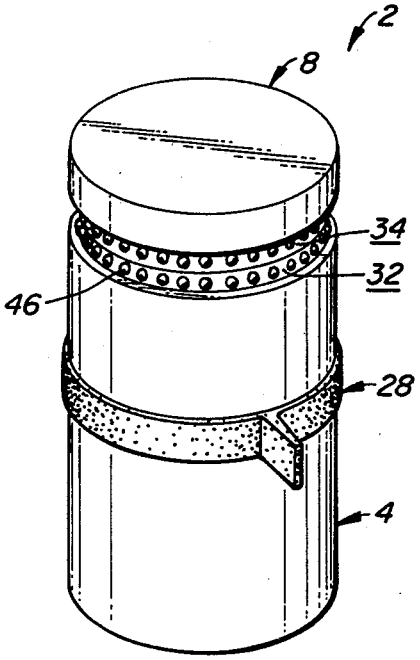

FIGS. 5 and 6 show further embodiments similar to that of FIG. 3 in which groove surfaces 32, 34 are configured to enhance the resistance to turning produced by elastic band 38. In FIG. 6 groove surfaces 32, 34 both have hexagonal shapes which are aligned when cap 8 is fully threaded onto receptacle 4. After placing elastic band 28 within common groove 26, rotary motion between cap 8 and the receptacle 4 is resisted by the frictional forces between surfaces 32, 34 and inside surface 30 of elastic band 28. However rotation of cap 8 causes the hexagonal surfaces to become misaligned. This misalignment tends to deform band 28 to substantially increase the resistance to the removal of cap 8.

In the embodiment of FIG. 6 groove surfaces 32, 34 have a number of projections 46 extending from such surfaces. These projections increase the frictional resistance between inside surface 30 of elastic band 28 and grooved surfaces 32, 34 to further hinder removal of cap 8 by young children.

Other modifications and variations can be made to the disclosed embodiments without departing from the subject of the invention as defined in the following claims. For example groove 26 may have an arcuate, instead of rectangular, cross-sectional contour. Also, inside surface 30 of band 28 may have an irregular contour instead of a smooth one as in the disclosed embodiments.

I claim:

1. A child-resistant container comprising:

a receptacle having an open top;

a cap configured for covering said open top;

rotational engagement means for securing said cap to said receptacle;

said receptacle and cap having juxtaposed external grooves formed about their respective outer surfaces, said grooves bounded by juxtaposed groove surface portions of said outer surfaces; and means, removably mounted within said grooves, for inhibiting relative rotary motion between said cap and said receptacle.

2. The child-resistant container of claim 1 wherein said receptacle has circular cross-sectional shape.

3. The child-resistant container of claim 1 wherein said rotational engagement securing means includes threads formed on said cap.

4. The child-resistant container of claim 3 wherein said threads are left-hand threads.

5. The child-resistant container of claim 1 wherein said groove surface portions are cylindrical surfaces.

6. The child-resistant container of claim 1 wherein said groove surface portions are polygonal surfaces.

7. The child-resistant container of claim 6 wherein said motion inhibiting means includes an elastic band so said polygonal surfaces deform said band upon relative rotary motion between said cap and said receptacle.

8. The child-resistant container of claim 1 wherein said motion inhibiting means is resilient.

9. The child-resistant cap of claim 1 wherein said motion inhibiting means includes an elastic band.

10. The child-resistant cap of claim 9 wherein said groove surface portions are irregular to enhance the friction between said said elastic band and said receptacle and said cap so that rotation of said cap is resisted by said elastic band being pulled in opposite rotary directions by said receptacle and said cap.

11. The child-resistant cap of claim 9 wherein said elastic band includes a tab to aid removal of said band from said groove by an adult user so that upon removal of said band said cap can be easily removed from said receptacle.

12. A child-resistant cap comprising:

a receptacle having an open top;

a cap sized for covering said open top;

said cap and receptacle having complementary left-hand threads for securing said cap to said receptacle;

said cap and receptacle having adjacent groove surfaces about their outer surfaces, said groove surfaces bounding adjacent external grooves formed in said outer surfaces;

an elastic band sized to fit snuggly within and substantially cover both said grooves, said band having a tab for grasping by a user, said band and groove surfaces adapted to resist relative motion between said groove surfaces and said band, whereby relative rotary motion between said receptacle and said cap is resisted by said band where said band is in said grooves but such relative rotary motion is substantially unhindered when said band is removed from said grooves.

* * * * *